US006216606B1

(12) United States Patent
Kathardekar et al.

(10) Patent No.: US 6,216,606 B1
(45) Date of Patent: Apr. 17, 2001

(54) ARTICLE OF FURNITURE

(75) Inventors: Vinit Gopal Kathardekar, San Jose, CA (US); Satchidanand Ram Rishi, Ford City, PA (US)

(73) Assignee: Jayashree R. Kathardekar, San Jose, CA (US)

( * ) Notice: Subject to any disclaimer, the term of this patent is extended or adjusted under 35 U.S.C. 154(b) by 0 days.

(21) Appl. No.: 09/264,783

(22) Filed: Mar. 9, 1999

Related U.S. Application Data

(60) Provisional application No. 60/077,392, filed on Mar. 10, 1998.

(51) Int. Cl.[7] ..... A47B 37/00
(52) U.S. Cl. ..... 108/50.02; 312/223.6
(58) Field of Search ..... 108/50.01, 50.02, 108/23; 312/223.6

(56) References Cited

U.S. PATENT DOCUMENTS

| | | | | |
|---|---|---|---|---|
| 4,372,629 | * | 2/1983 | Propst et al. | 312/223.6 |
| 4,688,491 | * | 8/1987 | Herrera et al. | 108/50.02 |
| 5,103,741 | * | 4/1992 | Grund et al. | 312/223.6 X |
| 5,121,698 | * | 6/1992 | Kelley | 108/50.02 X |
| 5,154,126 | * | 10/1992 | Newhouse et al. | 108/50.02 |
| 5,231,562 | * | 7/1993 | Pierce et al. | 108/50.02 X |
| 5,451,101 | | 9/1995 | Ellison et al. . | |
| 5,568,773 | * | 10/1996 | Hung | 108/50.02 |
| 5,878,673 | * | 3/1999 | Kramer et al. | 108/50.02 |
| 5,931,103 | * | 8/1999 | Huang | 108/50.02 |

FOREIGN PATENT DOCUMENTS

| | | | | |
|---|---|---|---|---|
| 10277 | * | 4/1980 | (EP) | 108/50.02 |
| 2279002 | * | 12/1994 | (GB) | 312/223.6 |
| 81000965 | * | 4/1981 | (WO) | 312/223.6 |

* cited by examiner

*Primary Examiner*—Jose V. Chen
(74) *Attorney, Agent, or Firm*—Vinit G. Kathardekar

(57) ABSTRACT

Provided is an article of furniture. The article of furniture comprises a horizontal member connected to a vertical support. The horizontal member has a slot and a slot cover, wherein the slot cover (such as slidable tiles) allows for an uncovered portion of the slot and wherein the uncovered portion is relocatable to at least two different locations. The uncovered portion is sized to receive an electrical cord of an apparatus supported by the horizontal member, and the horizontal member is placed directly against a wall. An optional vertical member, such as a back panel of a desk has its own passageway and passageway cover similar to the slot and the slot cover of the horizontal member.

30 Claims, 2 Drawing Sheets

ARTICLE OF FURNITURE

This application is based on, and claims priority from, U.S. Provisional Patent Application Ser. No. 60/077,392 filed on Mar. 10, 1998 which is included herein in its entirety by reference.

FIELD OF INVENTION

The present invention relates generally to an article of furniture, and more particularly to an article of furniture which is capable of accepting/supporting equipment or apparatus having an external energy transmission line such as, but not limited to, an electric power cord.

BACKGROUND OF THE INVENTION

There is a wide variety of home, office, or factory furniture available and used that, for example, is capable of accepting/supporting equipment having an external energy transmission line.

Widely used articles of furniture that support a variety of objects or equipment such as, but not limited to, a radio having an electric power cord, a television having an antenna wire or fiber optic or wire cable, a telephone having a phone cord, a computer connected to an electrical cord, a network cable, etc. include a table, desk, a chest of drawers, and the like. Different designs of desks and tables are used, including ergonomically designed desks and tables that offer ergonomic support to computer users.

A majority of such desks and tables back close to a wall and are generally placed near an electrical outlet which powers the electrical equipment.

It is a common sight to see electrical cords hanging from computers, or other electrical equipment, over the back and/or side edges of desks, before they get plugged into electrical outlets in the walls. The hanging electrical cords prevent desks or tables from being in direct contact with the walls behind, thereby creating a gap between the desk and the wall. These electrical cords may get pinched between the desk and the wall thereby creating a safety hazard. It is also very common to have objects such as pens, pencils, and other stationary fall in the gaps behind the desks. These fallen objects are not easily accessible unless one moves the desk or makes other heroic efforts to retrieve them. These gaps can be unsafe, unsightly, and a waste of room space.

Office desks are known which have two or three holes in the desk top which accept electric power cords, such cords extending from the equipment to the nearest hole and then through the desk top to the floor, and underneath the desk's back panel to an electric outlet. Cords extending from the equipment can get pinched by the back panel of the desk thereby creating a potential hazard. Such desks must be spaced from the wall to create a gap between the ba ck panel and the wall for the plug. These desks thus do not solve the problems discussed above. One person is known to have drilled a large hole in the back panel over the electric outlet to eliminate the need for the gap.

There is thus a need for an article of furniture which can be placed arbitrarily against a wall without a gap, while accommodating the arbitrary placement on the article of furniture of equipment or apparatus whose external energy transmission lines can be connected to arbitrarily located wall electrical outlets.

SUMMARY OF THE INVENTION

Keeping the above needs in mind, the present invention provides an article of furniture which while used to place equipment, such as a computer, on it also facilitates the placing of a desk or table in close proximity to a wall while avoiding wires hanging over its edges.

One embodiment of the present invention provides an article of furniture including: (a) a generally vertical support; (b) a generally horizontal member, wherein the horizontal member is connected to the vertical member, wherein the horizontal member comprises a lower surface and an upper surface, and wherein the horizontal member has a slot extending from the upper surface to the lower surface; and (c) apparatus for covering the slot, wherein the slot covering apparatus allows for a first uncovered portion of the slot and wherein the first uncovered portion is relocatable to at least two different locations.

Another embodiment of the present invention provides an article of furniture including: (a) a generally horizontal member, wherein the horizontal member comprises a lower surface and an upper surface and wherein the horizontal member has a slot extending from the upper surface to the lower surface; (b) a generally vertical member, wherein the vertical member has opposing and generally vertical first and second surfaces, wherein the vertical member has a passageway extending from the first surface to the second surface; and wherein the horizontal member is connected to the vertical member; and (c) apparatus for covering the passageway, wherein the passageway covering apparatus allows for a first uncovered relocatable portion of the passageway.

BRIEF DESCRIPTIONS OF THE DRAWINGS

The accompanying drawings illustrate two preferred embodiments of the present invention wherein.

DETAILED DESCRIPTION OF THE DRAWINGS

Figure 1:
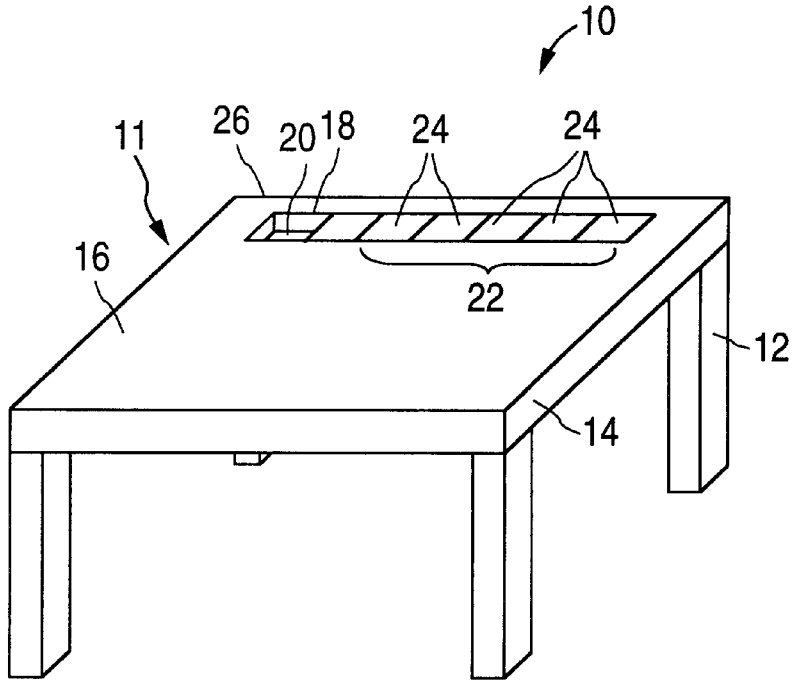
FIG.1 is a schematic perspective view of a first preferred embodiment of the article of furniture of the present invention.
Figure 2:
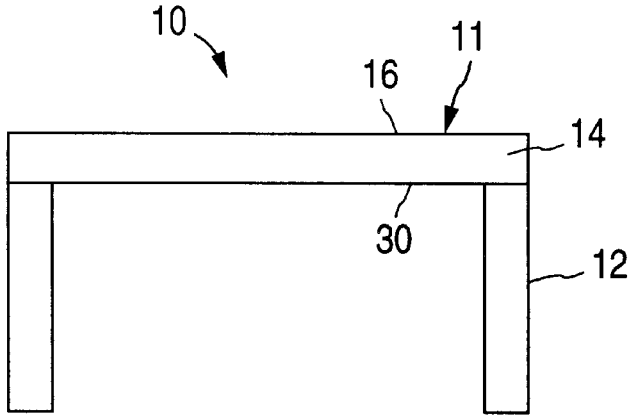
FIG. 2 is a front elevational view of the article of furniture of FIG. 1.

Referring now to the drawings, FIGS. 1–2 show one of the articles of furniture 10 of the present invention, wherein the article of furniture 10 is a table 11. The table 11 includes generally vertical supports 12 (which are the legs of the table) and a generally horizontal member 14 (which is the top of the table). The horizontal member 14 is connected (directly or indirectly) to the vertical supports 12. The horizontal member 14 comprises an upper surface 16, and a back edge 26, the back edge 26 preferably being abuttingly disposable against a wall. The upper surface 16 in turn comprises a slot 18 preferably located proximate the back edge 26 of the horizontal member 14. The table 11 also includes covering means 22 for covering the slot 18 while allowing for a first uncovered portion 20. Preferably the covering means 22 comprises a plurality of tiles 24 that allow the first uncovered portion 20 to be relocated generally along the length of the slot 18, to at least two different locations. The dimensions of the first uncovered portion 20 are such that it allows the passage of at least one external energy transmission line (such as an electrical or other power supply cord, telephone cord, or the like) through it. The slot 18 and the first uncovered portion 20 extend from the upper surface 16 of the horizontal member 14 to the lower surface 30 (shown in FIG. 2) of the horizontal member 14. Preferably the length of the slot 18 is at least generally equal to 50 percent of the length of the edge 26.

Shown in FIG. 2 is a front elevational view of the table 11, one embodiment of the instantly claimed article of furniture 10. As mentioned previously, the table 11 comprises vertical supports 12 directly or indirectly attached to the horizontal member 14. The depiction of the table 11 shows the upper surface 16 and the lower surface 30 of the horizontal member 14.

Figure 3:
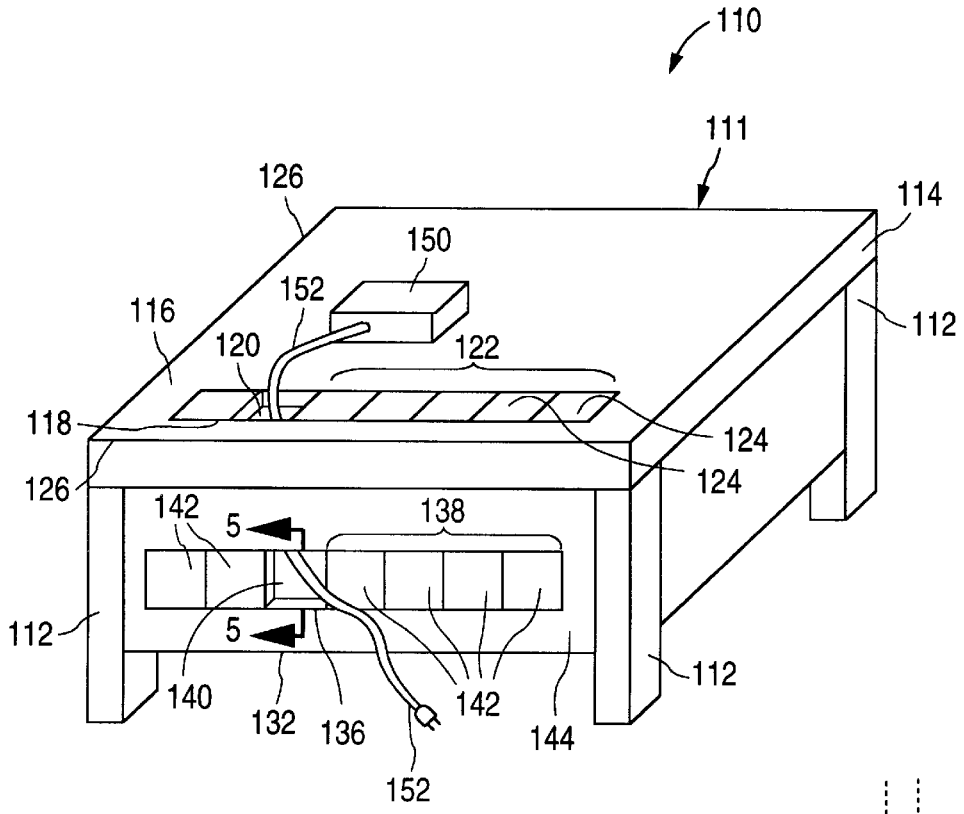
FIG. 3 is a schematic perspective of a second preferred embodiment of the article of furniture the present invention.

Shown in FIG. 3 is a schematic perspective view of another embodiment of the article of furniture 110, i.e., a desk 111. The vertical supports 112 are attached, directly or indirectly, to the horizontal member 114, of the desk 111. Also shown is the vertical member 132 disposed between the vertical supports 112. The vertical member 132 could be directly or indirectly attached, or partially or completely unattached to the vertical support 112 and the horizontal member 114. The horizontal member 114 is shown to comprise an upper surface 116. The vertical member 132 includes a second vertical surface 144 (shown in FIG. 5), and disposed within the second vertical surface 144 is a passageway 136, wherein the desk 111 also comprises a covering means 138, which allows for a first, and preferably includes an uncovered portion 140, and tiles 142 slidably disposed in the passageway 136. The tiles 142, taken together, form a preferred second covering means 138. The uncovered portion 140 and the passageway 136 extend from the first vertical surface 134 (shown in FIG. 5) to the second vertical surface 144 of the vertical member 132. Shown in FIG. 3 is the desk 111 such that the first uncovered portion 120 of the slot 118 is in communication with the first uncovered portion 140 of the passageway 136. Also shown is an electrically powered apparatus 150 having an electrical cord 152, the cord being inserted in the first uncovered portion 120 of the slot 118 and is shown exiting from the first uncovered portion 140 of the passageway 136.

Figure 4:
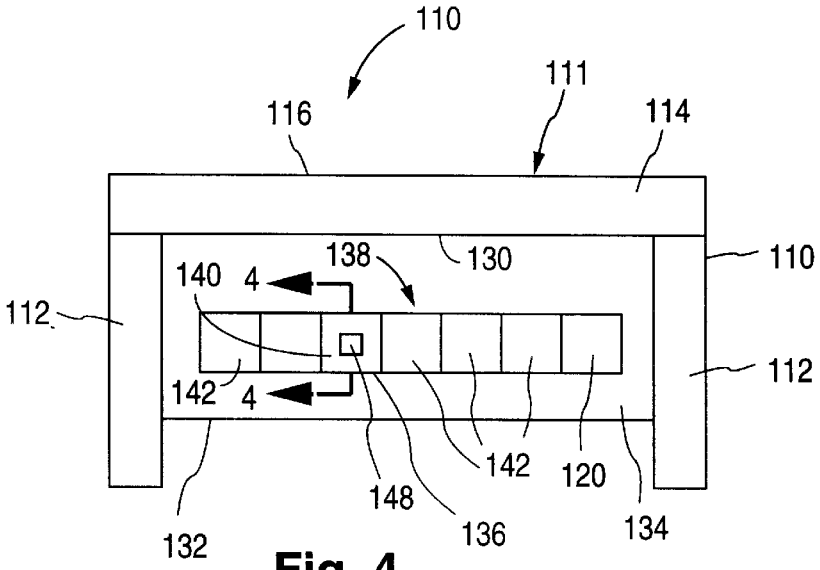
FIG. 4 is a front elevational view of the article of furniture of FIG. 3.

A front elevational view of a second preferred embodiment of the article of furniture 110, i.e., a desk 111, is shown in FIG. 4. Shown are the vertical supports 112, attached to the horizontal member 114, of the desk 111. This FIG. 4 also shows a vertical member 132 disposed between the vertical supports 112. The vertical member 132 could be directly or indirectly attached, or partially or completely unattached, to the vertical supports 112, and the horizontal member 114. The horizontal member 114 is shown to comprise an upper surface 116 and a lower surface 130. The vertical member 132 includes a first vertical surface 134, and disposed within the first vertical surface 134 is a passageway 136, wherein the desk 111 comprises a covering means 138, which allows for an uncovered portion 140, and which preferably includes tiles 142 slidably disposed in the passageway 136. The tiles 142 taken together form a preferred covering means 138. The uncovered portion 140 and the passageway 136 extend from the first vertical surface 134 to a second vertical surface 144 (shown in FIGS. 3 and 5) of the vertical member 132. Shown in FIG. 4 is the desk 111 such that the uncovered portion 140 of the passageway 136 is aligned to make the electrical outlet 148 accessible.

Figure 5:
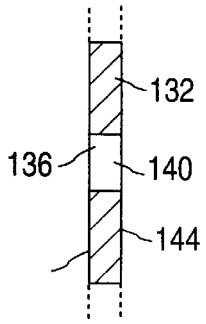
FIG. 5 is view taken along arrows 4—4 of FIG. 4 and 5—5 of FIG. 3.

Depicted in FIG. 5 is a cross sectional view of the vertical member 132 including the passageway 136. This figure shows the first uncovered portion 140, the first vertical surface 134 and the second vertical surface 144.

A preferred embodiment comprises the slot 118 located within the horizontal member 114 such that a cord 152 introduced through the first uncovered portion 120 of the slot 118 drops inside the first vertical surface 134 of i.e., the non-wall side of the vertical member 132. The electric cord 152 can then be inserted through the uncovered portion 140 of the passageway 136 and plugged in an electrical outlet 148. The advantage of such an arrangement is that, the electrical cord 152 does not hang over the back edge 126 of the desk 110, thereby enabling the positioning of the back edge 126 of the horizontal member 114 in close and preferably abutting contact with a wall. Such close contact between the back edge 126 of the horizontal member 114 substantially or completely eliminates any gaps between the wall and the desk 111, eliminating any cord-pinching hazard.

The instantly disclosed invention can be practiced in different ways. Thus slots 18 and 118 can be located along the side edges of the horizontal members 14 and 114 respectively. Such an arrangement will enable the placement of equipment 150 towards the side edges and electrical outlets 148, closer to the side of the table 11 or the desk 111 which could now be easily accessed. It should be noted that the horizontal member 114 can also be positioned such that the slot 118 in the upper surface 126 of the horizontal member 114 opens outside the second vertical surface 114 of (i.e., the wall side of) the vertical member 132. Such an arrangement, which is part of the instant invention, enables positioning of the equipment 150 near any edge of the article of furniture 110, and also helps hide electrical cords 152. It is also possible to have the slot 18 or 118 wherein the covering means 22 or 128, the tiles 22 or 122 and the uncovered portion are incorporated in an appropriately sized flat surface which can be attached to existing articles of furniture so as to be able to practice the invention disclosed herein.

Keeping the above discussed needs and other needs in mind, a first preferred embodiment of the present invention provides an article of furniture 10 (e.g. a table 11) comprising: (a) a generally vertical support 12; (b) a generally horizontal member 14, wherein the horizontal member 14 is connected to the vertical member 12, wherein the horizontal member 14 has a lower surface 30 and an upper surface 16, and wherein the horizontal member 14 has a slot 18 extending from the upper surface 16 to the lower surface 30; and (c) means 22 for covering the slot 18, wherein the covering means 22 allows for a first uncovered portion 20 of the slot 18 and wherein the first uncovered portion 20 is relocatable to at least two different locations.

Also provided by the instant invention is an article of furniture 10 (e.g. the table 11) wherein said upper surface 16 is generally planar and wherein said covering means 22 covers the slot 18 preferably at the upper surface 16 of the horizontal member 14. A preferred embodiment provides an article of furniture 10 wherein the covering means 22 comprises a plurality of tiles 24 slidably disposed in the slot 18 at the upper surface 16 of the horizontal member 14.

Another preferred embodiment provides an article of furniture 10 (e.g. the table 11) wherein the tiles 24 are imperforate, horizontally-slidably disposed in the slot 18, and together cover less than the entire slot 18. Another preferred embodiment provides an article of furniture 10 wherein the tiles 24 together cover the entire slot 18 and at least one if the tiles 24 has a hole. A further preferred embodiment provides an article of furniture 10 wherein the horizontal member 14 has an edge abuttingly disposable against a wall and wherein the slot 18 is located proximate the edge. Yet another preferred embodiment provides an article of furniture 10 wherein the slot 18 and the first uncovered portion 20 are sized to accept an electrical cord 152. It is further preferred that the upper surface 16 is sized to support an electrically powered apparatus 150 connected to the electrical cord 152. A particularly preferred embodiment of the instant invention provides an article of furniture 10, wherein the horizontal member 14 is a table top.

A second embodiment of the instant invention provides an article of furniture 110 (e.g. a desk 111) comprising: (a) a generally horizontal member 114, wherein the horizontal member 114 has a lower surface 130 and an upper surface 1 16 and wherein the horizontal member 114 has an opening 120 extending from the upper surface 116 to the lower surface 130; (b) a generally vertical member 134, wherein the vertical member 132 has opposing and generally vertical first and second surfaces 134 and 144, wherein the vertical member 132 has a passageway 136 extending from the first surface 134 to the second surface 144; and wherein the horizontal member 114 is connected to the vertical member 132; and (c) means 138 for covering the passageway 136, wherein the covering means 138 allows for a first uncovered portion 140 of the passageway 136 and wherein the first uncovered portion 140 is relocatable to at least two different locations.

Preferred aspects of this embodiment provide an article of furniture 110 (e.g. the desk 111) wherein the passageway covering means 138 comprises a plurality of tiles 142 horizontally-slidably disposed in the passageway 136 of the vertical member 132. In one construction the tiles 142 are imperforate and together cover less than the entire passageway 136. In another construction, not shown in the figures, the tiles 142 together cover the entire passageway and at least one of the tiles has a hole. Yet another embodiment of the instant invention provides an article of furniture 110 wherein the vertical member 132 is disposable proximate a wall and wherein the passageway 136 is located at a predetermined height equal to the standard height of an electric wall outlet 148.

The instant invention also provides an article of furniture 110 (e.g. the desk 111) wherein the uncovered portion (opening) 120 is in communication with the passageway 136, and wherein the first uncovered portion (opening) 120, the passageway 136, and the first uncovered portion 140 of the passageway 136 are sized to accept an electrical cord 152. A particularly preferred embodiment of the instant invention provides an article of furniture 10 wherein the upper surface 116 is generally planar and sized to support an electrically powered apparatus 150 connected to the electrical cord 152, and wherein the horizontal member 116 is a desk top. A further particularly preferred embodiment of the instant invention provides an article of furniture 110 which includes means 122 for covering the slot 118, wherein the means 122 allows for a first uncovered portion 120 of the slot 118 and wherein the first uncovered portion 120 of the slot 118 is relocatable to at least two different locations.

It is understood that the present invention includes any article of furniture that can be used to support an electrical apparatus, whether such article of furniture is used commercially, industrially, or domestically. The general requirement is that slot covering means and the passageway covering means include slidable, hingeable, snap-on, or removable tiles, or the like. The function of such slot covering means and passageway covering means is to provide an uncovered portion which can be used for the passage of an electrical cord. Even an article of furniture comprising drawers is part of the present invention. Illustrative examples of such articles of furniture include, without limitation, a chest of drawers, armoire, and the like. A television, for example, can be placed on top of a chest of drawers (which is often the case in many homes) and the electrical cord from the television can be passed through an uncovered portion of a slot on the upper surface of the chest of drawers. The electrical cord can then drop behind the drawers and the plug can emerge through an uncovered portion of a passageway which is generally located on the vertical member which generally covers the back edge of the drawers. The arrangement of the drawers and the back panels can be easily accomplished by one skilled in the art.

Another arrangement can include an appropriately sized flat surface, comprising a slot, covering means, and tiles, thereby providing an uncovered portion, attached to an edge of a chest of drawers, armoire, or the like.

One advantage of the instant invention is that the article of furniture can be moved close to the wall. This increases safety since, especially in areas where children are present, the close proximity of the article of furniture to a wall reduces the exposure of the electrical outlets where children could get hurt. Also, the instantly described invention helps hide the electrical cords which can become a hazard if left exposed. As can be seen, the instant invention has a wide range of applications. The instantly claimed invention is safe and convenient to use and fills a long standing need of easy handling of cords from equipment when placed on an article of furniture.

The present invention can also be practiced wherein the generally horizontal surface, having the slot, is a separate piece which is later attached to an article of furniture originally manufactured without one or all of the previously described elements of the present invention at the desired edge of the conventional article of furniture. This helps increase the utility of the existing articles of furniture. Another way of practicing the invention is one where the generally horizontal surface having the slot is mounted on a vertical support thereby providing a bench surface. It is noted that the slot can be located at any desired edge of the generally horizontal surface such that electrical cords from equipment can be passed through the uncovered portion to enable their engagement with the electrical wall outlet. The slidable, removable, hingeable, snap-on, and the like slot covering means makes it convenient for the placement of electrical equipment at any desired location on the bench top, some other article of furniture, or the like.

Similarly the passageway in the vertical member, with the slidable, hingeable, snap-on, removable, and the like passageway covering means facilitates the first uncovered portion of the passageway to be appropriately located proximate the electrical wall outlet, enabling access to the electrical outlet. Also included in the present invention are articles of furniture which include a plurality of passageways arranged vertically or horizontally, in parallel or otherwise, to enable access to the electrical outlets.

It should be noted that the uncovered portion can serve to accommodate a wide variety of cords. Illustrative examples are electrical cords, telephone cords, cable TV cords, modem wires, cords used to lock or secure a instrument in place, and cords used to connect equipment with each other.

The present invention can also be used in conjunction with a door like arrangement used on the inner vertical surface of the vertical member such that once the electrical cord is connected to the electrical outlet, the door, or the like can be used to hide the cord(s). Such a door, or doors, can be slidable, hinged, or the like. Such an arrangement essentially forms a box like structure wherein the upper end of such a box has the slot with the uncovered portion which can be in communication with the uncovered portion located on the vertical member of such a box. This arrangement enables the power cord to be introduced through the uncovered portion at the upper end of such a box and the power cord can exit the box through the uncovered portion located on the vertical member so as to be connected to the electrical outlet.

What we claim is:

1. An article of furniture comprising:

(a) a generally vertical support;

(b) a generally horizontal member, wherein said horizontal member is connected to said vertical support, wherein said horizontal member has a lower surface and an upper surface, and wherein said horizontal member comprises a slot extending from said upper surface to said lower surface; and (c) means for covering said slot, wherein said covering means allows for a first uncovered portion of said slot and wherein said first uncovered portion is relocatable to at least two different locations, wherein said upper surface is generally planar and wherein said slot covering means covers said slot generally at said upper surface of said horizontal member, and wherein said slot covering means comprises a plurality of tiles disposed in said slot at said upper surface of said horizontal member, and wherein said tiles are horizontally-slidably disposed in said slot, imperforate and together, cover less than the entire slot.

2. The article of claim 1, wherein said tiles together cover the entire slot and at least one if said tiles has a hole.

3. The article of claim 1, wherein said horizontal member has an edge abuttingly disposable against a wall and wherein said slot is located proximate said edge.

4. The article of claim 3, wherein said slot and said first uncovered portion are sized to accept an electrical cord.

5. The article of claim 4, wherein said upper surface is sized to support an electrically powered apparatus connected to said electrical cord.

6. The article of claim 5, wherein said horizontal member is a table top.

7. The article of furniture of claim 3, wherein the length of the slot is at least generally equal to 50 percent of the length of said edge.

8. An article of furniture comprising:

(a) a generally horizontal member, wherein said horizontal member has a lower surface and an upper surface and wherein said horizontal member has a slot extending from said upper surface to said lower surface;

(b) a generally vertical member, wherein said vertical member has opposing and generally vertical first and second surfaces, wherein said vertical member has a passageway extending from said first surface to said second surface; and wherein said horizontal member is connected to said vertical member; and (c) means for covering said passageway, wherein said passageway covering means allows for a first uncovered portion of said passageway and wherein said first uncovered portion is relocatable to at least two different locations, wherein said passageway covering means comprises a plurality of tiles disposed in said passageway of said vertical member, and wherein said tiles are imperforate, horizontally-slidably disposed in said passageway, and together cover less than the entire passageway.

9. The article of claim 8, wherein said tiles together cover the entire passageway and at least one of said tiles has a hole.

10. The article of claim 9, wherein said passageway is located at a height that facilitates access to an electrical wall outlet.

11. The article of claim 10, wherein said slot is in communication with said passageway.

12. The article of claim 11, wherein said slot, said passageway and said first uncovered portion of said passageway are sized to accept an electrical cord.

13. The article of claim 12, wherein said upper surface is generally planar and sized to support an electrically powered apparatus connected to said electrical cord.

14. The article of claim 13, wherein said horizontal member is a desk top.

15. The article of claim 8, also including means for covering said slot, wherein said slot covering means allows for a first uncovered portion of said slot and wherein said first uncovered portion of said slot is relocatable to at least two different locations.

16. An article of furniture comprising:

(a) a generally vertical support;

(b) a generally horizontal member, wherein said horizontal member is connected to said vertical support, wherein said horizontal member has a lower surface and an upper surface, and wherein said horizontal member comprises a slot extending from said upper surface to said lower surface and disposed inward from any said vertical support;

(c) means for covering said slot, wherein said covering means allows for a first uncovered portion of said slot and wherein said first uncovered portion is relocatable to at least two different locations, wherein said upper surface is generally planar and wherein said slot covering means covers said slot generally at said upper surface of said horizontal member, wherein said slot covering means comprises a plurality of tiles disposed in said slot at said upper surface of said horizontal member, and wherein said tiles are horizontally-slidably disposed in said slot, imperforate, and together cover less than the entire slot.

17. The article of claim 16, wherein said tiles together cover the entire slot and at least one if said tiles has a hole.

18. The article of claim 17, wherein said horizontal member has an edge abuttingly disposable against a wall and wherein said slot is located proximate said edge.

19. The article of claim 18, wherein said slot and said first uncovered portion are sized to accept an electrical cord.

20. The article of claim 19, wherein said upper surface is sized to support an electrically powered apparatus connected to said electrical cord.

21. The article of claim 20, wherein said horizontal member is a table top.

22. The article of claim 18, wherein the length of the slot is at least generally equal to 50 percent of the length of said edge.

23. An article of furniture comprising:

(a) a generally horizontal member, wherein said horizontal member has a lower surface and an upper surface and wherein said horizontal member has a slot extending from said upper surface to said lower surface;

(b) a generally vertical member, wherein said vertical member has opposing and generally vertical first and second surfaces, wherein said vertical member has a passageway extending from said first surface to said second surface; and wherein said horizontal member is connected to said vertical member and wherein said slot is disposed inward from any said vertical support; and (c) means for covering said passageway, wherein said passageway covering means allows for a first uncovered portion of said passageway and wherein said first uncovered portion is relocatable to at least two different locations, wherein said passageway covering means comprises a plurality of tiles disposed in said passageway of said vertical member and wherein said tiles are imperforate, horizontally-slidably disposed in said passageway, and together cover less than the entire passageway.

24. The article of claim 23, wherein said tiles together cover the entire passageway and at least one of said tiles has a hole.

25. The article of claim 24, wherein said passage way is located at a height that facilitates access to an electrical wall outlet.

26. The article of claim 25, wherein said slot is in communication with said passageway.

27. The article of claim 26, wherein said slot, said passageway and said first uncovered portion of said passageway are sized to accept an electrical cord.

28. The article of claim 27, wherein said upper surface is generally planar and sized to support an electrically powered apparatus connected to said electrical cord.

29. The article of claim 28, wherein said horizontal member is a desk top.

30. The article of claim 23, also including means for covering said opening, wherein said slot covering means allows for a first uncovered portion of said slot and wherein said first uncovered portion of said slot is relocatable to at least two different locations.

* * * * *